United States Patent [19]

Brunner

[11] Patent Number: 4,862,599

[45] Date of Patent: Sep. 5, 1989

[54] PROCESS AND APPARATUS FOR DRYING WOOD

[75] Inventor: Reinhard Brunner, Ronneberg, Fed. Rep. of Germany

[73] Assignee: Gesellschaft Fur Messtechnik mbH, Fed. Rep. of Germany

[21] Appl. No.: 195,818

[22] Filed: May 19, 1988

[30] Foreign Application Priority Data

May 26, 1987 [DE] Fed. Rep. of Germany ..... 3717659

[51] Int. Cl.[4] ..... F26B 21/06

[52] U.S. Cl. ..... 34/46; 34/54; 34/191

[58] Field of Search ..... 34/54, 53, 191, 45, 34/46, 47, 51

[56] References Cited

U.S. PATENT DOCUMENTS

| | | | |
|---|---|---|---|
| 1,546,180 | 7/1925 | Osborn | 34/54 |
| 1,601,966 | 10/1926 | Harris | 34/54 X |
| 1,736,213 | 11/1929 | Mueller | 34/191 |
| 1,829,139 | 10/1931 | Henderson | 34/191 X |
| 4,356,641 | 11/1982 | Rosenau | 34/54 |

FOREIGN PATENT DOCUMENTS

| | | | |
|---|---|---|---|
| 0142071 | 5/1985 | European Pat. Off. . | |
| 508465 | 9/1930 | Fed. Rep. of Germany . | |
| 595596 | 7/1959 | Italy | 34/191 |

*Primary Examiner*—Harry B. Tanner

*Attorney, Agent, or Firm*—Roylance, Abrams, Berdo & Goodman

[57] ABSTRACT

Drying stacked cut wood in a drying chamber is accomplished by conducting air between the layers of cut wood. Before and/or during the drying, the air velocity profile in the plane of admission into the stack is adjusted to a modifiable theoretical value. The drying apparatus has at least two measuring sensors for the wood moisture level and/or the flow velocity of the air. The sensors are arranged at some distance from each other in the area of the stack. A flow control system is adjustable dependent upon the measured values obtained by the measuring sensors.

17 Claims, 1 Drawing Sheet

PROCESS AND APPARATUS FOR DRYING WOOD

CROSS-REFERENCE TO RELATED APPLICATION

This application is related to U.S. patent application Ser. No. 754,273, U.S. Pat. No. 4,753,020 to Reinhard Brunner, filed July 12, 1985 and entitled Dryer For Wood, the subject matter of which is hereby incorporated by reference.

FIELD OF THE INVENTION

The present invention relates to a process and apparatus for drying cut wood including a fan generating an air flow between the layers of cut wood to dry the cut wood.

BACKGROUND OF THE INVENTION

It is conventional to set the air velocity for a drying chamber at a certain level within the stack of wood based upon the geometry of the drying chamber, the conveying capacity of the fans, the aerodynamic resistance of the heating radiator, the size and arrangement of the stack of wood, as well as stack configuration factors. During the drying each fan is set or adjusted according to the type of wood, the wood thickness and the wood moisture level, as well as the desired quality to be obtained by the adjustment of the speed of the fan or fans.

With this computation, however, a number of parameters or factors, for instance the precision of the stacking, deviations called air short circuits, the surface area condition of the wood, modifications of the layers of wood as a result of shrinkage, unfit or improper stack strip ledges or borders and the like, are not taken into consideration. Additionally, the flow velocities between the individual cut wood layers can deviate considerably from the desired levels. With greater total stack height, the differences, in the flow velocities between the individual partial flows penetrating between the wood layers, increase a great deal. These differences in the flow velocities cause individual areas of the wood to dry at different speeds.

Depending on whether the measuring points for control of the drying cycle are selected to be in better or in poorer air flowthrough areas, the measurements, and therefore, the conventional processes and apparatus can produce low quality goods as a result of too high or too low levels of wood moisture. Too high moisture levels lead to discolorations and the formation of mold. Too low moisture levels can result in overdried goods, and with extended drying time, can also raise the cost of the process. If the charges of wood being processed have different original moisture levels, additional drying damages can occur, such as planking or revetting, warped areas and crevices, especially if the more moist charges are being air-dried more strongly than the drier, standard charges.

SUMMARY OF THE INVENTION

Objects of the present invention are to provide a drying process and apparatus which avoid the above described drying difficulties, permit drying even different types of woods with differences in thicknesses and/or drying properties simultaneously in one chamber, and function effectively producing better quality wood than has been possible with known processes and apparatus.

The foregoing objects are obtained by a process for drying cut wood arranged in a stack with a plane of admission in a drying chamber and with interposed stack strips. The process comprises the steps of generating an air flow by at least one fan, conducting the air flow between layers of the cut wood, and adjusting air flow directions to direct the air flow onto different partial areas of the stack plane of admission in a timed sequence.

The foregoing objects are also obtained by an apparatus for drying cut wood arranged in a stack with a plane of admission and with interposed stack strips. The apparatus comprises a drying chamber, at least one fan means for producing air flows mounted in the drying chamber, at least two sensor means mounted in the drying chamber for measuring wood moisture, wood moisture gradients or air flow velocity at two measuring points spaced from each other in the drying chamber, adjustable air flow regulating means for modifying the air flows in the chamber, and control means. The control means is coupled to the sensor means and the regulating means for adjusting the regulating means dependent on measurements obtained by the sensor means.

In addition to the traditional temperature and moisture considerations, the air velocity between the stacked boards is counted as one of the parameters which most greatly influence the advancement of the drying. For given chamber temperature and moisture conditions, the process and apparatus of the present invention can differently dry different areas of a stack of wood, which areas have different wood moisture levels, types of wood and thicknesses of wood, solely by variation of the air flow velocities in these areas. The required air flow velocities are set and adjusted with a suitable air velocity profile in the plane of admission of the air defined by the stack. Because the flow velocity of the individual air flows penetrating between the cut wood layers or at least of groups of these air flows is adjusted dependent upon measured values, which values are directly or indirectly characteristic for the flow condition, including the wood moisture, the moisture gradients and/or the air velocity, it is possible to considerably reduce the deviation of the flow velocity from theoretical value in the channels formed by the cut wood layers. In this manner, uniform drying can be attained, or the drying times of the different parts to be dried can be assimilated to each other.

Furthermore, it is possible to correct the flow velocity, when unacceptable wood moisture differentials arise in the course of the drying. Without correction, the unacceptable wood moisture differentials could lead to a considerable final moisture level divergence. It is even possible to continuously execute an actual value/theoretical value comparison computed on the basis of the measured values serving as actual value, and to regulate the flow velocity accordingly. Therefore, a uniform final moisture level can be attained with the process and apparatus according to the present invention, using the shortest possible drying time and the lowest possible consumption of energy.

Preferably, the requisite air velocity profile is adjusted and modified by a modification of the air control before entry of the air between the cut wood layers. In this manner, a very effective individual control of the flow velocities between the wood layers can be attained at low cost, even when the wood stack is of great height. Insofar as is required, the volume and/or the pressure of the air can also be varied before the entry of the air flow between the cut wood layers.

In order to execute the process using as few measured values as possible, one preferred embodiment measures values for the wood moisture and/or air velocity at certain points which are at different levels above the bottom and throughout the area or space of the drying chamber. With a drying chamber of greater depth, computation and evaluation of the measured values at various different depths, including at different points on the same level and at different levels perpendicular to the direction of flow through the stack or stacks, will generally be required. There are limit values for the velocity of a continuous air flow through the wood stack, which are traditionally maintained in order not to compromise good drying results and to attain an efficient and effective drying.

From the point of view of efficiency and effectiveness (including costs and capital level involved), an upper limit for the air velocity is determined by the type of wood, thickness of the wood, moisture of the wood and moisture gradient, as well as by the climatic conditions of the drying chamber. Exceeding the air velocity upper limit for a longer time can result in the dreaded planking or revetting, when rapid drying out of the area adjacent to the surface of the wood layers creates a moisture gradient which is too great through the board cross section (the moisture gradient). As a result planking or revetting, drying process is greatly slowed down; and there is the danger of the destruction of the wood by the formation of crevices.

The lower limit of the continuous air velocity depends upon the length of the air flow passage through the stack. With too low air flow velocity before admission into the wood stack, the air reaches moisture equilibrium with the wood surface too soon, well before its discharge. The air then becomes completely saturated, above and beyond the fiber saturation level (which is for instance to be expected with freshly sawn wood), so that it cannot absorb more moisture from the wood on the rest of its way through the stack. As a result of this, in the course of the drying, an increasing wood moisture profile or moisture level differential is developing progressively along the air passage through the stack, with, in the case of a reverse mode, the wood stack profile is symmetrical to the middle point of the stack.

This undesirable effect makes it especially necessary to subject the stack to a higher flow velocity in the case of large drying chambers with long air passages through the stack, requiring more outlay than would otherwise be required for the desired effective drying procedure. Especially this high air velocity is required only in the drying segment above the areas where the wood fibers are saturated. For a wood moisture below the fiber saturation, unnecessary electrical energy would be consumed for the wood moisture levels being effected throughout the stack, because of the excessive fan load required for the drying in this case. This discrepancy can now to be met by use of pole-changeable motors, or use of frequency transverters. In addition to other drawbacks, however, there remains the high capital expenditure involved. Because of the very high fan load required, at the beginning of the drying, the fan chamber must be built up correspondingly higher, mainly to be able to install the necessary number of fans.

These drawbacks likewise can be avoided with the features of the present invention, without increasing the drying and the capital investment costs by too high a fan load.

A concentrated air flow at high velocity is directed onto all of the areas of admission into the stack one after the other. Therefore, the air flow concentration is attained by a suitable positioning of the fans and/or setting of the air control devices or regulating means. With the high velocity of the air flow certain volumes of air remain within the stack for only a quite brief period such that moisture equilibrium could not be attained within the wood or respectively the saturation moistures of the wood parts could not be reached. Planking or revetting cannot occur since the relatively slow moisture conveyance in the wood will not create disadvantageously high wood moisture gradients when the phase or duration of higher velocity do not last too long. The different cyclical median values of air velocity for the drying procedure can therefore be lowered without any problem. The length of time for the high velocity phase for individual stack areas is selected so as to be sufficiently short in comparison with the length of duration of the low velocity phase.

With sufficiently high concentrations of the total air flow even the reversal of air flow direction can be eliminated. Thus, air flow control devices on one of the two stack ends can be eliminated and the total drying cycle timing control can be simplified.

Different wood charges can be dried effectively with the process and apparatus of the present invention in one single chamber at the same time. In such circumstances, the duration of the drying time, during which a certain stack area is subjected to the concentrated air flow, can be varied dependent upon the moisture and/or the moisture gradient of the wood in this area.

In one preferred embodiment, the air flow control device or regulating means comprise adjustable air conducting surfaces. The various parts of the stack or the different wood parts can be fed in a simple manner by such air conducting surfaces. The required volumes of air are dependent upon the conditions. At least if the position of the fan or fans influences the distribution of the air on the gaps between the wood layers, the velocity of the individual air flows can also be influenced by adjusting, for instance, by pivoting of the fan or fans. Generally speaking, however, adjustability of the fans can suffice only in combination with adjustable air conducting surfaces.

The air conducting surfaces and the fans, if they are adjustable, can be manually adjusted. Preferably, however, adjusting mechanisms are provided to carry out the adjustments by an automatic control device or a timing device.

As is often the case, a horizontal flow passage is provided above the part of the drying chamber space holding the cut wood, in which passage the fan or fans are located. At at least one of the two ends of this flow passage, air conducting surfaces advantageously are mounted and are configured as reversing or deflecting elements. The deflection of the air flow can then take place with the aid of these devices, so that the admission openings into the intermediate spaces present between the wood layers can be acted upon with the requisite air flows.

In addition to these air conducting surfaces or when those air conditioning surfaces are not adjustable, air conducting surfaces configured as reversing or deflecting elements can be provided at different levels on the air entry side and discharge side of the cut wood stack. These reversing or deflecting elements can be adjustable pivotally around a horizontal axis and adjustable vertically by being arranged in a holder. The total stack height can then be subdivided to some extent into some plurality of sections, within which sections the air flows can be adjusted or controlled independently of each other. The setting and positioning of the reversing or deflecting elements in any particular case should be independent of each other. These positions could, for instance, be determined dependent upon the wood moisture and the wood moisture gradients, measured at individual, spaced measuring points, by means of a tracking program on a computer, with the measurements being converted into the required control commands. Thus, resetting potentiometers can be mounted on servomotors for evaluating the data at any of the positions at any given moment. The flow control can also be selected so that certain stack parts are, at least in part, no longer particularly being subjected to the circulating air.

In addition to the coordination of the flow velocity in the flow passages lying one over the other in vertical arrangement, it can be desirable or can even be required to coordinate the air distribution transverse to the direction of flow in the flow passages, i.e., in alignment to the depth of the chamber. Such coordination of the flow velocity can compensate for wood moisture differentials in the depth direction of the chamber, or can act differently upon stacks of wood arranged adjacent to each other along the depth of the chamber. For this purpose only, at least two of the reversing or deflecting elements need to be arranged in series extending in the depth direction of the chamber, to be able to effect the air flow along the entire depth of the chamber.

Another solution of the drying divergence problem is derived from the adjustability of the reversing or deflecting elements located in front of the admission point into the stack. Such elements can be adjusted regarding a vertical element in their rotation plan or regarding two different directions of rotation, preferably perpendicular to one another.

If the fans are arranged in a passage separated from the remainder of the drying chamber by an intermediate partition over the stack of wood, preferably each fan is adjustable around a vertical axis. With suitable rotation of the fans, the air flows can be directed onto one or more areas along the depth of the chamber.

If maximum angles of fan rotation of more than 180 degrees (for instance 270 degrees) are selected, an additional reversal or deflection of the air direction can be attained with fans which operate in only one direction of rotation. Such single direction fans have an approximately 1–20% higher degree of effectiveness than reversible fans.

If at least two fans are arranged on a side adjacent to the wood stack, the fans are arranged one over the other. Each fan is preferably adjustable about a horizontal axis independent of the other fans. By suitable fan positioning the air flows can be controlled as desired for variable impact on the selected horizontal wood layer.

If a reversal of the direction of flow is provided, a wood moisture equalization can be obtained when different wood moisture levels are present in the areas of the beginning and the end of the channels formed by the layers of wood. Different duration reversing time periods are then used in the area of the air admission and the air discharge points into and from the passages formed through the layers of wood. In case of the reversability of the direction of flow, air conducting surfaces are preferably provided on both sides of the drying chamber.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
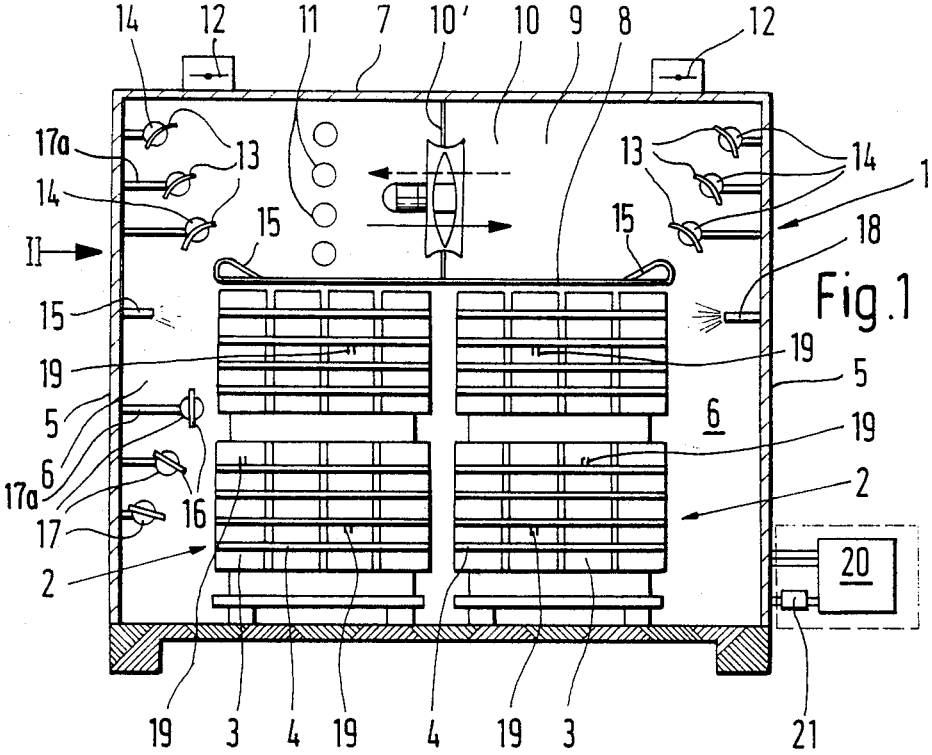
FIG. 1 is a side elevational view in section of an apparatus for drying cut wood according to the present invention.

A drying chamber 1 according to the present invention is intended to receive at least one stack 2 of cut wood 3 to be dried and arranged with stack strips 4 between two adjacent layers of cut wood. In the exemplary embodiment, drying chamber 1 has a cubical shape and is provided on one side with an aperture (not shown). The aperture closes and seals drying chamber 1 during the drying process. Stacks of wood 2 are arranged adjacent to one another in drying chamber 1, and if necessary one behind the other. Stack strips 4 extend transverse to the alignment of drying chamber 1. A relatively wide space 6 remains free adjacent to and between each of the two side walls 5 of the drying chamber and stacks 2 of wood.

At some distance below the top limiting wall 7 of drying chamber 1, a partition wall 8 extends parallel to top limiting wall 7. Partition wall 8 extends over the entire depth of drying chamber 1, but wall 8 ends at some distance from the two side walls 5, a distance equal to the width of space 6. Partition wall 8 separates a flow passage 9 from the part or space of drying chamber 1 holding stacks 2, but places flow passage 9 in communication at both sides with spaces 6.

In the exemplary embodiment, two axial fans 10 are arranged so that they can effect the entire depth of drying chamber 1. The fans are adjustable around a vertical axis 10'. Each fan has a setting motor for the fan adjustment in emergency. A heat radiator 11 is arranged lengthwise along flow passage 9 at some distance from axial fans 10. Entry and discharge air valves 12 in top limiting wall 7 of drying chamber 1 facilitate air entry and discharge to provide reduction of the air humidity. Of course, the air can also be subjected to the effect of a dehumidifier device.

Adjustable air conducting surfaces 13 are located in both top corner areas of drying chamber 1 where spaces 6 are in communication with both ends of flow passage 9 and where the air flow is subjected to a 90 degree change or reversal of direction. These air conducting surfaces 13 are of rectangular shape and are bent or curved in a transverse direction to form an open channel directed toward the middle of the inside of drying chamber 1. Each air conducting surface 13 may be of sheet aluminum and is supported by a horizontal axis. The lengthwise sides of air conducting surfaces 13 run parallel to the horizontal axes. Air conducting surfaces 13 can be pivotally adjusted around these axes by one electric setting motor 14 for each air conducting surface.

As shown in FIG. 1, air conducting surfaces 13 are located in the space between the end of partition wall 8 and the corner formed by top limiting wall 7 and side walls 5, and are at different distances from the end of partition wall 8. Partition wall 8 also includes a flow conducting member 15 on the side turned toward flow passage 9, and has on its opposite end an identically configured flow conducting member 15'.

Additional air conducting surfaces 16, as shown in FIG. 1, are arranged in both spaces 6 at different levels above the bottom of the chamber. Each surface 16 is formed of a flat, rectangular strip of sheet metal. The distances from the side wall 5 increase from bottom to top of the illustrated arrangement. Each air conducting surface 16 is supported on one horizontal shaft. The lengthwise sides of air conducting surfaces 16 run parallel to the shafts. These rotatably mounted shafts are each coupled with an electric setting motor 17. The setting motors are supported for height adjustment by holders 17*a*.

Figure 2:
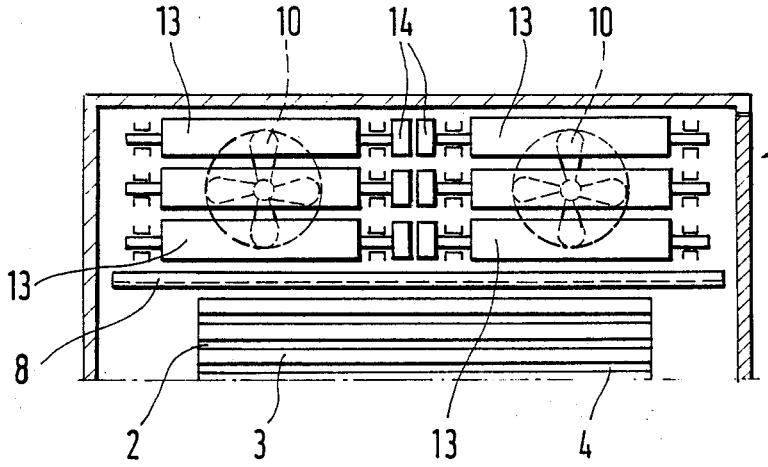
FIG. 2 is a partial front elevational view in section of the apparatus of FIG. 1.

FIG. 2 shows an exemplary embodiment in which, because of the great depth of drying chamber 1, the air conducting surfaces 13 and 16 do not extend to the entire depth of the chamber. Two identically configured air conducting surfaces having two different setting motors, one for each, are arranged adjacent to each other, to influence differently the air flow in different areas over the total depth of the chamber.

Spray nozzles 18 on side walls 5 of drying chamber 1 allow humidification of the air.

Individual wood layers at different levels of wood stack 2 are each provided with a moisture sensor or velocity sensor 19, each supplying an analogous measuring signal. These moisture sensors 19 are connected by connection lines with an electronic control circuit 20. Control circuit 20 is located outside drying chamber 1 from which point the total operation is controlled. More than one transverter 21 is connected to control circuit 20, for continuously setting the velocity of the drive motors of axial fans 10. The direction of rotation can be supplied beforehand. Spray nozzles 18 and setting motors 14 and 17, as well as heating radiator 11, and the motors for the setting the pivot points of axial fans 10 are all controlled by control circuit 20.

Control circuit 20 determines the optimum air velocity of the air flows between the individual cut wood layers based on the data obtained regarding cut wood 3 subjected to drying in drying chamber 1. The positioning of air conducting surfaces 13 and 16 and the rotational velocity of axial fans 10 are predetermined accordingly. The air velocity is maintained based on the measured values supplied from humidity sensors 19. If necessary, adjustment of conducting surfaces 13 and/or 16 and of the rotational velocity of axial fans 10 and/or their pivot points, corresponding to a program setting at a predetermined theoretical value is accomplished. This program can also include a reversal of the direction of flow.

While various embodiments have been chosen to illustrate the invention, it will be understood by those skilled in the art that various changes and modifications can be made therein without departing from the scope of the invention as defined in the appended claims.

What is claimed is:

1. A process for drying cut wood arranged in a stack with a plane of admission in a drying chamber and with interposed stack strips, comprising the steps of:

generating an air flow, directing the air flow onto the plane of admission of the stack where channels formed between the cut wood layers begin, directing the air flow in a sequence to produce a concentration of air flow at different parts of the plane of admission producing a higher velocity air flow in the channels beginning in a part of the plane of admission experiencing a concentrated air flow, than in the other channels, measuring at least one of wood moisture, wood moisture gradient and flow velocity in the stack on different levels, adjusting the concentration of air flow dependent upon measured values of at least one of wood moisture, wood moisture gradient and flow velocity so that the flow velocity in the channels with the higher velocity avoids moisture equalization of air and wood within such channels, and changing the concentration of air flow to a next part of the plane of admission after a period dependent upon measured values at least of one of wood moisture gradient and wood moisture.

2. A process according to claim 1 wherein the air flow is generated by at least one fan.

3. A process according to claim 2 wherein the concentrate of air flow is adjusted by varying the direction of the fan.

4. A process according to claim 2 wherein the concentrate of air flow direction is adjusted by varying air flow control means in the drying chamber.

5. A process according to claim 2 wherein adjustment of the concentrate air flow is modified in response measurements of wood moisture made of at least two moisture measuring points spaced from each other in the stack.

6. A process according to claim 5 wherein the measurements of wood moisture determine a moisture gradient in the wood.

7. A process according to claim 5 wherein air flow velocity is evaluated at at least one point directly adjacent to one of the moisture measuring points.

8. A process according to claim 5 wherein durations of directing air flow against each part of the stack plane of admission are adjusted and set dependent on moisture measurements of the wood in the corresponding partial area.

9. An apparatus for drying cut wood arranged in a stack with a plane of admission and with interposed stack strips, comprising:

a drying chamber;

at least one fan means for producing air flows mounted in said drying chamber;

at least two sensor means, mounted in said drying chamber, for measuring at least one of wood moisture, wood moisture gradients and air flow velocity at two measuring points spaced from each other in said drying chamber;

adjustable air flow regulating means for directing the air flows in the chamber onto the plane of admission of the stack where channels formed between the cut wood begin and for modifying the air flows to produce a concentration of air flow at different parts of the plane of admission producing a higher velocity air flow in the channels beginning in a part of the plane of admission experiencing a concentration of air flow, than in the other channels; and control means, coupled to said sensor means and said regulating means, for adjusting said regulating means in sequence dependent on measurements obtained by said sensor means.

10. An apparatus according to claim 9 wherein said drying chamber comprises a wood receiving space and a flow passage separated from and adjacent to said wood receiving space; and said air flow regulating means comprises relatively adjustable air conducting surfaces positioned at opposite ends of said flow passage.

11. An apparatus according to claim 10 wherein said flow passage is located above said wood receiving space.

12. An apparatus according to claim 10 wherein said air deflecting surfaces comprise individually adjustable deflecting elements, and are located at different levels on air entry and air discharge sides of the stack of cut wood.

13. An apparatus according to claim 10 wherein adjustable mounting means supports said fan means in said flow passage for varying directions of said fan means.

14. An apparatus according to claim 10 wherein said air flow regulating means comprise air conducting surfaces pivotally mounted in said drying chamber.

15. An apparatus according to claim 9 wherein said air flow regulating means comprise air conducting surfaces supported by mounting means for permitting height adjustment of said air conducting surfaces in said drying chamber.

16. An apparatus according to claim 9 wherein said air flow regulating means comprise air conducting surfaces and setting motors for varying positions of said air conducting surfaces.

17. An apparatus according to claim 9 wherein setting motor means is coupled to said fan means to vary positioning thereof.

* * * * *